US009320087B2

(12) United States Patent
Takahashi et al.

(10) Patent No.: US 9,320,087 B2
(45) Date of Patent: Apr. 19, 2016

(54) CONDUCTIVE FABRIC

(71) Applicant: TOYOTA BOSHOKU KABUSHIKI KAISHA, Aichi-ken (JP)

(72) Inventors: Akari Takahashi, Aichi-ken (JP); Fumitoshi Akaike, Aichi-ken (JP)

(73) Assignee: TOYOTA BOSHOKU KABUSHIKI KAISHA, Aichi-Ken (JP)

( * ) Notice: Subject to any disclaimer, the term of this patent is extended or adjusted under 35 U.S.C. 154(b) by 176 days.

(21) Appl. No.: 13/928,748

(22) Filed: Jun. 27, 2013

(65) Prior Publication Data

US 2015/0004372 A1 Jan. 1, 2015

(51) Int. Cl.

| | |
|---|---|
| ***H01B 7/00*** | (2006.01) |
| ***H05B 3/34*** | (2006.01) |
| ***D03D 1/00*** | (2006.01) |
| ***H05B 3/12*** | (2006.01) |
| ***D03D 15/00*** | (2006.01) |

(52) U.S. Cl.

CPC ..... *H05B 3/342* (2013.01); *D03D 1/0088* (2013.01); *D03D 15/00* (2013.01); *H05B 3/12* (2013.01); *H05B 3/345* (2013.01); *H05B 3/347* (2013.01); *D10B 2401/16* (2013.01); *D10B 2505/12* (2013.01); *H05B 2203/011* (2013.01); *H05B 2203/015* (2013.01); *H05B 2203/016* (2013.01); *H05B 2203/017* (2013.01); *H05B 2203/029* (2013.01); *Y10T 428/24777* (2015.01)

(58) Field of Classification Search

CPC ..... H05B 2203/17; H05B 2203/011; H05B 2203/015; H05B 2203/029; H05B 2203/005; H05B 2203/036; H05B 3/342; H05B 3/34; H05B 3/36; H05B 1/0238; H05B 3/12; H05B 3/345; H05B 3/347; H05B 2203/017; H05B 2203/29; D03D 1/0088; D03D 15/00; D10B 2401/16; D10B 2405/12; Y10T 428/24777

USPC ..... 219/200, 212, 213, 217; 428/192

See application file for complete search history.

(56) References Cited

U.S. PATENT DOCUMENTS

| | | | | |
|---|---|---|---|---|
| 8,524,622 | B2 | 9/2013 | Akaike et al. | |
| 2004/0100131 | A1* | 5/2004 | Howick et al. | 297/180.12 |
| 2010/0258334 | A1* | 10/2010 | Akaike et al. | 174/126.1 |

FOREIGN PATENT DOCUMENTS

| | | |
|---|---|---|
| JP | 63-95193 | 6/1988 |
| JP | 63-133087 | 8/1988 |
| JP | 3-11585 | 1/1991 |
| JP | 6-76926 | 3/1994 |
| JP | 2010-245006 | 10/2010 |
| JP | 2010-254006 | 10/2010 |

OTHER PUBLICATIONS

Japanese Office Action for JP App. No. 2012-001097 dated May 13, 2015, along with English-language translation thereof.

* cited by examiner

*Primary Examiner* — Jeremy R Pierce

(74) *Attorney, Agent, or Firm* — Greenblum & Bernstein, P.L.C.

(57) ABSTRACT

In a conductive fabric that includes conductive yarn and non-conductive yarn, a fabric end edge in a region that includes an end portion of at least a portion of the conductive yarn is provided in a position recessed farther to an inside of a fabric surface than a fabric end edge in another region. The end portion of the at least a portion of the conductive yarn is provided to the inside of the fabric surface.

6 Claims, 5 Drawing Sheets

CONDUCTIVE FABRIC

BACKGROUND OF THE INVENTION

1. Field of the Invention

The invention relates to conductive fabric. More particularly, the invention relates to conductive fabric that includes conductive yarn and non-conductive yarn, in which a portion of the conductive yarn is electrically insulated from the other conductive yarn and an external member.

2. Description of Related Art

Conductive fabric that includes conductive yarn is known, and is used for heaters and various sensors and the like using conductivity. For example, this kind of conductive fabric is used for a seat cover of a vehicle seat, and is used as a seat cover provided with a seat heater or a capacitance seating sensor.

When passing current through the conductive fabric that includes conductive yarn, the conductive yarn is often connected to another conductive connecting member at an end portion of the conductive fabric. The connecting member is further connected to a power supply or a control device or the like. Japanese Patent Application Publication No. 2010-245006 (JP 2010-245006 A) describes one method for connecting the conductive yarn to the connecting member at the end portion of the conductive fabric. This method involves removing a portion of insulating fiber (i.e., non-conductive yarn) that forms cloth material, separating it into a cloth material main body and a cloth material piece, and exposing a plurality of conductive wires (i.e., conductive yarn) from this separated portion. Then the connecting member is wrapped around the conductive wires that are exposed from this separated portion and the conductive wires are sewn in place, such that the conductive wires are electrically connected to the connecting member.

A method such as this is preferable as a method for electrically connecting all of the conductive yarn present in a given region in the conductive fabric to the connecting member. However, when the conductive fabric is used as a heater, for example, there may be cases in which conductive yarn that is to be electrically connected to the connecting member is adjacent to or mixed in the same region with conductive yarn that is to be electrically insulated from the connecting member and not connected to it, such as when adjusting the output of the heater by the number (i.e., the density) of conductive yarns that are carrying current (i.e., energized), or when a heated location and a non-heated location are provided in adjacent regions in a single conductive fabric. In such a case, the method that involves bundling the conductive wires exposed from the separated portion and wrapping the connecting member around them is unable to be used as it is.

For example, as shown in FIG. 5, with the method described in JP 2010-245006 A above, a conductive yarn 42 is first exposed from a separated portion 44, and then if a conductive yarn that is not to be electrically connected to the connecting member, i.e., a non-used conductive yarn 42*b*, is cut at a location of an end edge 41*a* of a conductive fabric 41, the conductive yarn that is not to be electrically connected to the connecting member is able to be set using the method described above. If, when a sheet-like connecting member that has conductivity is attached to the end edge 41*a* of the conductive fabric 41, the conductive member of the cut surface of the non-used conductive yarn 42*b* will not be connected, electrical insulation between the non-used conductive yarn 42*b* and the connecting member is ensured. However, in actuality, when the non-used conductive yarn 42*b* is only cut at the location of the end edge 41*a* of the conductive fabric 41, conductive material that is exposed at the cross-section of the cut non-used conductive yarn 42*b* tends to contact the connecting member, and as a result, an electrical connection with the connecting member ends up being formed.

Even if the cut surface does not contact the connecting member in the connecting member connecting step, if force strong enough to bendably deform the conductive fabric 41 or the connecting member is applied to the conductive fabric 41 or the connecting member while current is flowing to a current-carrying conductive yarn 42*a* (i.e., a conductive yarn that will be energized) that is connected to the connecting member, for example, the connecting member might easily contact the cut surface of the non-used conductive yarn 42*b*, and the non-used conductive yarn 42*b* may easily contact the current-carrying conductive yarn 42*a* that is close to the non-used conductive yarn 42*b*. If this happens, current will be supplied to the non-used conductive yarn 42*b* via the connecting member, and a short will occur between the non-used conductive yarn 42*b* and the current-carrying conductive yarn 42*a* that is close to this non-used conductive yarn 42*b*.

Thus, a method may be employed that involves attaching the connecting member after covering the portion where the current-carrying conductive yarn 42*a* has been cut at the location of the end edge 41*a* of the conductive fabric 41, with an insulating member such as insulating tape-like cloth material or the like. With this method, insulation of the end portion of the non-used conductive yarn with respect to the connecting member is able to be ensured, but an insulating member that is a member separate from the conductive fabric 41 is required.

SUMMARY OF THE INVENTION

The invention thus provides conductive fabric that includes conductive yarn and non-conductive yarn, and is capable of insulating an end portion of conductive yarn that will not carry current from a connecting member and conductive yarn that will carry current, without using an insulating member that is a separate member, when connecting an external member such as a conductive connecting member to a portion of the conductive yarn that will carry current.

A first aspect of the invention thus relates to a conductive fabric that includes conductive yarn and non-conductive yarn, in which a fabric end edge in a region that includes an end portion of at least a portion of the conductive yarn is provided in a position recessed farther to an inside of a fabric surface than a fabric end edge in another region.

With the conductive fabric according to this aspect, when a member such as a conductive connecting member is connected to the end portion of conductive yarn that will carry current, a terminal of the conductive yarn that will not carry current is formed in a position away from the connecting member or the like and the end portion of the conductive yarn that will carry current. Therefore, the conductive yarn that will not carry current is electrically insulated from the connecting member and the like and the other conductive yarn. Accordingly, when current flows to the conductive yarn that will carry current, current will not end up flowing to the conductive yarn that will not carry current, and a short will not occur due to contact with nearby conductive yarn that is carrying current. Furthermore, the conductive yarn that will not carry current is able to be electrically insulated simply be setting the position of the terminal of the conductive yarn that will not carry current in the manner described above, so there is no need to use a separate insulating member such as the tape-like cloth material. Therefore, when connecting the conductive fabric to the connecting member, the number of parts is able to be reduced compared with when cutting a portion of the conductive yarn and covering the end portion with an insulating member.

In the aspect described above, the fabric end edge in the region that includes the end portion of the at least a portion of the conductive yarn may be provided in a position recessed farther to the inside of the fabric surface than the fabric end edge in the other region, by a portion of a weave of the conductive fabric, including the non-conductive yarn and the end portion of the portion of the conductive yarn, being removed. Also, the portion of the weave of the conductive fabric may be removed in a semicircular shape.

When a portion of the weave of the conductive fabric, including the non-conductive yarn and the end portion of the portion of the conductive yarn, is removed, electrical insulation between the conductive yarn that will not carry current and an external member such as a connecting member or the like and the surrounding conductive yarn that will carry current is able to be ensured simply by cutting out (i.e., removing) the end portion of the conductive yarn that will not carry current together with the surrounding non-conductive yarn. As a result, even if the conductive yarn that will carry current and the non-conductive yarn that will not carry current are adjacent and many of them are provided, the end portion of each of the conductive yarns that will not carry current is able to be reliably electrically insulated. Therefore, the insulating work is able to be performed relatively easily compared with the method described above, and problems regarding the insulating work, such as forgetting to perform the insulating work in one or some locations, are also able to be prevented. In addition, the location where the conductive fabric has been removed is able to be clearly visually recognized, so it is possible to easily determine, by the presence or absence of a removed portion, whether the insulating process has been performed for each conductive yarn, i.e., whether the conductive yarn is a conductive yarn that will not carry current or a conductive yarn that will carry current, for each conductive yarn. In this way, the presence or absence of the removed portion can also be used as an index in the manufacturing process of the conductive fabric and steps such as connecting a connecting member.

Also, in the aspect described above, the fabric end edge in the region that includes the end portion of the at least a portion of the conductive yarn may also be provided in the position recessed farther to the inside of the fabric surface than the fabric end edge in the other region, by forming a cut line parallel to a direction in which the at least a portion of the conductive yarn is arranged, in a portion formed by the non-conductive yarn that is arranged on both sides of the end portion of the at least a portion of the conductive yarn, and folding a piece that includes the end portion of the at least a portion of the conductive yarn that is sandwiched between two of the cut lines, to the inside of the conductive fabric.

In this way, if the end portion of the conductive yarn that will not carry current is withdrawn farther to the inside of the fabric surface than the end edge of the fabric in the other region, for the entire region that is made up of the surrounding non-conductive yarn, then even if the conductive yarn that will carry current and the conductive yarn that will not carry current are adjacent, insulation of the conductive yarn that will not carry current is able to be easily ensured. Furthermore, by forming the folded portion as described above, the strength of the fabric end edge is able to be increased.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
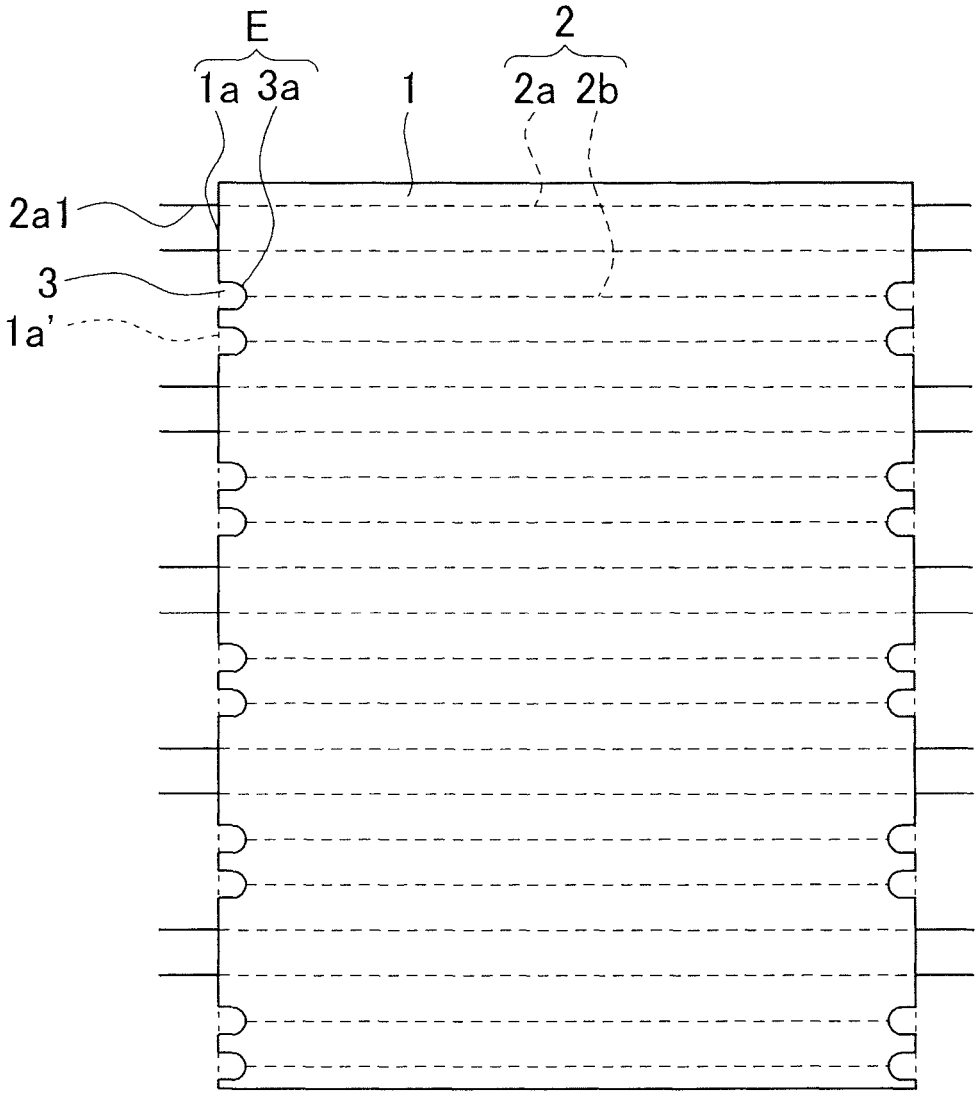
FIG. 1 is a front view of conductive fabric according to a first example embodiment of the invention.

First, conductive fabric according to a first example embodiment of the invention will be described in detail with reference to FIGS. 1 and 2. FIG. 1 is a front view of conductive fabric according to the first example embodiment of the invention. The conductive fabric according to this example embodiment may preferably be used as a cover for a vehicle seat, in which the conductive fabric itself will be heated and form a heater device, or as a heater device arranged on the back side of a seat cover.

The conductive fabric 1 has conductive yarn 2 and non-conductive yarn. As the conductive yarn 2, a wide variety of conductive fiber-like material, such as conductive wires formed only of conductive material such as thin metal wire, or conductive yarn in which these conductive wires are combined with other fibers, may be used. As the conductive wire, thin stainless steel wire that has high tensile strength and is highly corrosion resistant is preferably used. The outer periphery of the conductive wire may be covered with resin or the like. As the non-conductive yarn, a variety of fiber material with high insulation properties may be used.

As long as the conductive fabric 1 includes the conductive yarn 2 and the non-conductive yarn, the weave of the conductive fabric 1 is not limited. That is, the conductive fabric 1 may be formed with any weave, such as knit, woven, or non-woven. In this example embodiment, the conductive fabric 1 is formed by woven fabric. The conductive yarn 2 is arranged at equidistant intervals in substantially straight lines as part of warp yarn or weft yarn. When current is passed through the conductive yarn 2, the conductive yarn 2 consequently generates heat and functions as a planar heater device. In the drawings, the non-conductive yarn in the conductive fabric 1 is not clearly shown, but the region of the conductive fabric 1 other than the location where the conductive yarn 2 is arranged is formed by the non-conductive yarn. The conductive yarn 2 preferably not on the surface of the conductive fabric 1 so that another member or the body of a user or the like will not contact the conductive yarn 2.

When the conductive fabric 1 is formed by cutting it in a shape required for various uses from a long piece of woven fabric, the desired heating amount also differs depending on the use. For example, when the conductive fabric 1 is to be used as a vehicle seat heater, the desired heating amount differs according to the region of the seat. In this case, not all of the conductive yarn 2 will be energized, so the desired heating amount according to use or region may be obtained by providing conductive yarn to be energized (hereinafter referred to as "current-carrying conductive yarn") 2*a* and non-used conductive yarn 2*b* that will not be energized at intervals, and appropriately setting the ratio (i.e., the density) of the current-carrying conductive yarn 2*a*. In this example embodiment, the current-carrying conductive yarn 2*a* and the non-used conductive yarn 2*b* are alternately arranged every two strands, as an example.

A fabric end edge E that is provided in a direction orthogonal to the arrangement direction of the conductive yarn of the conductive fabric 1 is formed by a combination of a generally linear non-excised end edge 1*a* and a curved excised portion end edge 3*a* formed farther to the inside of the fabric surface than the non-excised end edge 1*a*. The excised portion end edge 3*a* includes a position where a terminal of the non-used conductive yarn 2*b* is arranged. On the other hand, the fabric end edge E in a region other than that, which includes a position of an end portion of the current-carrying conductive yarn 2*a*, is formed by the non-excised end edge 1*a*. In other words, the fabric end edge E in the region that includes the end portion of the non-used conductive yarn 2*b* (i.e., the excised portion end edge 3*a*) is formed in a position recessed farther to the inside of the fabric surface than the fabric end edge E in the other region (i.e., the non-excised end edge 1*a*).

Both end portions of the current-carrying conductive yarn 2*a* extend to the outside from the non-excised end edge 1*a* of the conductive fabric 1, and are exposed to the non-conductive yarn without the periphery thereof being surrounded by the non-conductive yarn. Furthermore, if the outer periphery of the current-carrying conductive yarn 2*a* is covered by resin or the like, the covering material is removed from the outer periphery of this extended portion 2*a*1, so that the conductive material is exposed. When the conductive fabric 1 is used as a heater, this exposed extended portion 2*a*1 is connected to a conductive connecting member 6, as will be described later.

Meanwhile, the excised portion end edge 3*a* is formed at the position of the end portion of the non-used conductive yarn 2*b*. The region surrounded by the excised portion end edge 3*a* and a virtually extrapolated end edge 1*a*' that is an extrapolation of the non-excised end edge 1*a* arranged on both sides of the excised portion end edge 3*a*, is an excised portion 3 where neither the conductive yarn 2 nor the non-conductive yarn are arranged. The non-used conductive yarn 2*b* has a terminal at the position of the excised portion end edge 3*a*. That is, the terminal of the non-used conductive yarn 2*b* is withdrawn farther to the inside of the fabric surface than the non-excised end edge 1*a*.

The size and shape of the excised portion 3 must be such that the terminal of the non-used conductive yarn 2*b* is reliably withdrawn from a conductive surface 6*a* of the connecting member 6 when the connecting member 6 is attached to the extended portion 2*a*1 of the current-carrying conductive yarn 2*a* that extends from the non-excised end edge 1*a*, as will be described later. However, if the excised portion 3 is formed too large, the strength of the overall conductive fabric 1 will end up being lower, so an appropriate size must be selected. Regarding the shape, in FIG. 1*a* generally semicircular excised portion 3 is formed, and the terminal of the non-used conductive yarn 2*b* is arranged in a position farthest from the extrapolated end edge 1*a*' on the arc. This structure enables the end portion of the non-used conductive yarn 2*b* to be effectively withdrawn to the inside of the fabric surface. An insulating coating may also be applied by forming a resin coating or the like, on the end portion of the non-used conductive yarn 2*b* that has the terminal at the position of the excised portion end edge 3*a*. However, as will be described later, forming the excised portion 3 enables sufficient electrical insulation to be obtained between an external member such as a conductive member and the nearby current-carrying conductive yarn 2*a*, so applying an insulating coating is simply not necessary.

Figure 3A:
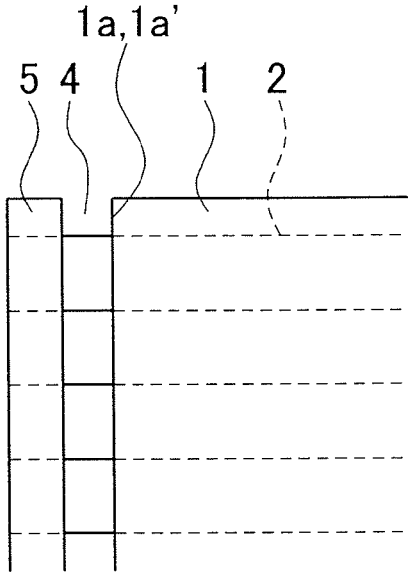
FIG. 3A is a view schematically showing a manufacturing method of the conductive fabric according to the first example embodiment of the invention.
Figure 3C:
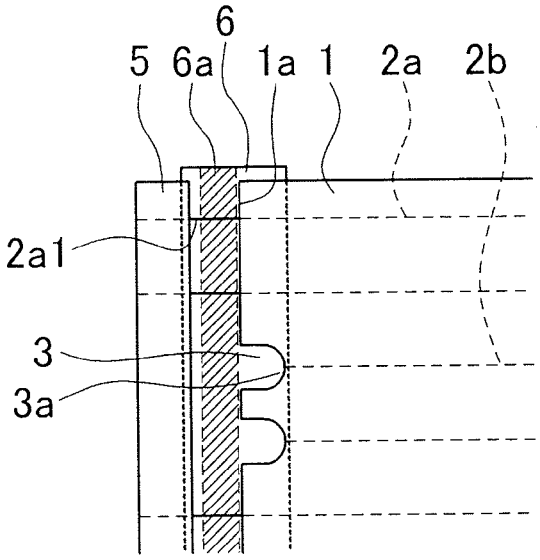
FIG. 3C is a view schematically showing an attaching method of a connecting member according to the first example embodiment of the invention.
Figure 3B:
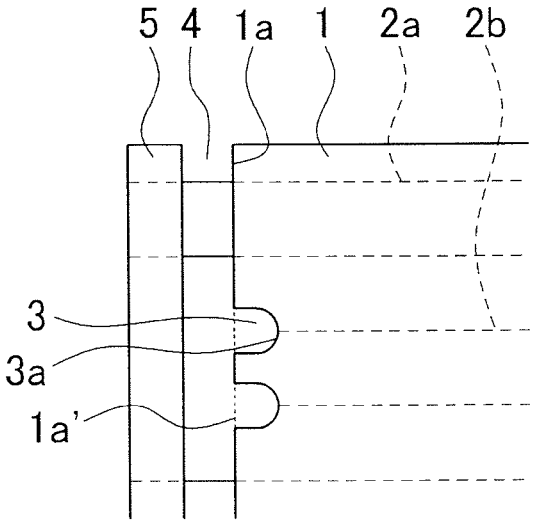
FIG. 3B is a view schematically showing the manufacturing method of the conductive fabric according to the first example embodiment of the invention.

In FIG. 1, no other conductive fabric or the like is connected to the tip end of the extended portion 2*a*1 of the current-carrying conductive yarn 2*a*, but a fabric piece 5 may be connected to the conductive fabric 1 via the current-carrying conductive yarn 2*a*, as shown in FIG. 3B. In this state, the extended portions 2*a*1 of the current-carrying conductive yarns 2*a* maintain their relative positions with respect to each other and are kept extended straight, so workability when forming the excised portion 3 or when connecting the connecting member 6 by sewing or the like is increased.

Figure 2A:
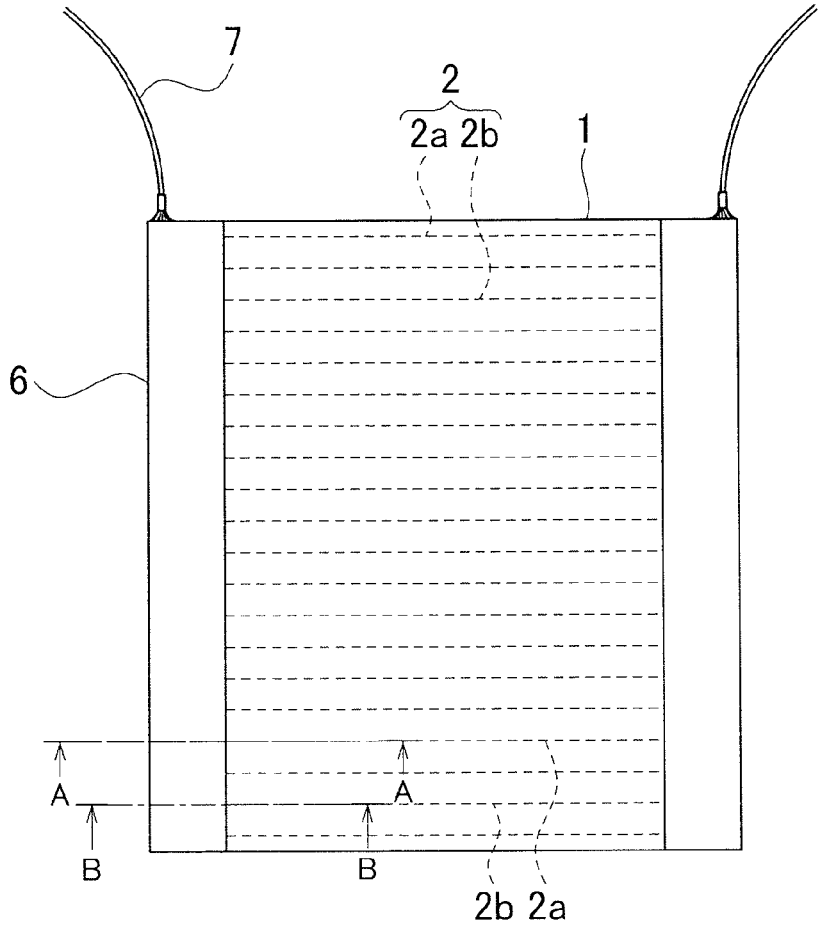
FIG. 2A is a front view of a state in which a connecting member is attached to an end edge of the conductive fabric in FIG. 1.

FIG. 2A is a view of a state in which the connecting member 6 is attached to the extended portion 2*a*1 of the current-carrying conductive yarn 2*a* of the conductive fabric 1 shown in FIG. 1. The connecting member 6 is a sheet member in which the conductive surface 6*a* that has conductivity is formed on at least one side. Some possible examples of this conductive sheet member include a member in which conductive material (such as copper) is formed in a sheet-shape, and conductive woven fabric that includes yarn made with conductive material. The connecting member 6 is formed with a generally U-shaped cross-section so as to sandwich the extended portion 2*a*1 of the current-carrying conductive yarn 2*a*, with the conductive surface 6*a* on the inside of the fabric surface. Then the connecting member 6 is attached to the fabric end edge E of the conductive fabric 1 by being sewed or the like. This connecting member 6 is connected to a power supply via a power line 7.

Figure 2B:
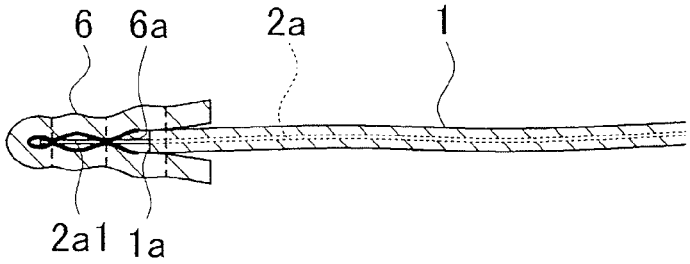
FIG. 2B is a sectional view taken along line A-A in FIG. 2A.

FIG. 2B is a sectional view of the position where the current-carrying conductive yarn 2*a* is arranged. The extended portion 2*a*1 is wrapped up by the connecting member 6 (i.e., the connecting member 6 is wrapped around the extended portion 2*a*1) and is contacting the conductive surface 6*a* of the connecting member 6. As a result, there is conduction between the current-carrying conductive yarn 2*a* and the connecting member 6, so the conductive fabric 1 is able to be heated by flowing current through the current-carrying conductive yarn 2*a*. In FIG. 2B, the extended portion 2*a*1 extends in a straight line, but the connecting member 6 may also be wrapped around the extended portion 2*a*1, with the extended portion 2*a*1 bent at an intermediate location.

Figure 2C:
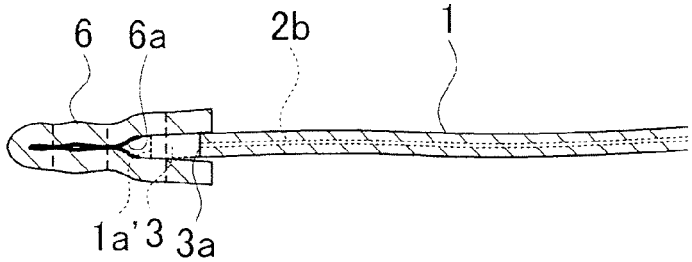
FIG. 2C is a sectional view taken along line B-B in FIG. 2A.

Meanwhile, FIG. 2C is a sectional view of the position where the non-used conductive yarn 2*b* is arranged. The connecting member 6 is a long thin sheet-like member that runs across the end portions of a plurality of conductive yarns 2, so the entire fabric end edge E of the conductive fabric 1, including the locations where the excised portion 3 is formed, are wrapped up. However, the end portion of the non-used conductive yarn 2*b* is withdrawn to the inside of the fabric surface by the excised portion 3, and thus will not contact the conductive surface 6*a* of the connecting member 6.

Therefore, there is no conduction between the non-used conductive yarn 2*b* and the connecting member 6, so even if current is supplied from the power supply to the connecting member 6 and current flows through the current-carrying conductive yarn 2*a*, no current will flow through the non-used conductive yarn 2*b*. Also, there is no contact with the extended portion 2*a*1 of the adjacent current-carrying conductive yarn 2*a*, so a short will not occur.

By forming the excised portion end edge 3*a* in a position sufficiently to the inside of the fabric surface of the conductive fabric 1, the position of the terminal of the non-used conductive yarn 2*b* is arranged in a position sufficiently away from the conductive surface 6*a* of the connecting member 6. Therefore, even if the connecting member 6 or the conductive fabric 1 bendably deforms while in use, there will be no contact between the end portion of the non-used conductive yarn 2*b* and the conductive surface 6*a* of the connecting member 6 or the extended portion 2*a*1 of the adjacent current-carrying conductive yarn 2*a*. When the conductive fabric 1 is used as a seat heater of a vehicle seat, the conductive fabric 1 will frequently be deformed, e.g., bend, following movement of an occupant when he or she gets in or out of the vehicle or is seated. Therefore, the structure in which the excised portion 3 is provided at the position of the end portion of the non-used conductive yarn 2*b*, as is the case in this example embodiment, is particularly effective.

Next, a manufacturing method of the conductive fabric 1 according to the example embodiment, and an example of a connecting method for connecting the connecting member 6 to the manufactured conductive fabric 1, will be described with reference to FIGS. 3A to 3D. First, as shown in FIG. 3A, rectangular conductive fabric (i.e., a fabric main body) 1 is formed connected to the fabric piece 5 by the conductive yarn 2 via the separated portion 4 where the non-conductive yarn has been removed. To form the conductive fabric 1 in this state, all that is needed is to prepare rectangular raw fabric that extends from the region of the conductive fabric 1 to the region of the separated portion 4 and the fabric piece 5, and remove only the non-conductive yarn from the region that is to become the separated portion 4. One example of a method for forming the separated portion 4 is a method that involves melting or burning the non-conductive yarn by emitting a laser beam while scanning the entire region that will become the separated portion 4. Alternatively, as described in the related art, the separated portion 4 may be formed by first cutting the non-conductive yarn in the area that will become the non-excised end edge 1*a* and the extrapolated end edge 1*a*' of the conductive fabric 1 in a straight line using a blade or a laser or the like, and then separating the portion that will become the fabric piece 5 from the conductive fabric 1 by pulling it out. In this case, unlike the case shown in FIG. 3A and the like, the current-carrying conductive yarn 2*a* in the fabric piece 5 will be pulled out to the separated portion 4 by an amount equal to the width of the separated portion 4. Regardless of which method is used, when using a laser, the output and wavelength of the laser must be set within a range that will melt or burn the non-conductive yarn, but will not melt or burn the conductive material that forms the conductive yarn 2. Also, when the current-carrying conductive yarn 2*a* has a coating of resin or the like on the outer periphery, this must also be removed. When the fabric piece 5 is not formed, the non-conductive yarn farther to the outside than the non-excised end edge 1*a* and the extrapolated end edge 1*a*' need simply be completely removed by one of the methods described above.

Next, the conductive yarn 2 that is to be the non-used conductive yarn 2*b* is selected, and the conductive fabric 1 in the area where the selected non-used conductive yarn 2*b* overlaps with the excised portion end edge 3*a*, and the region that includes the surrounding non-conductive yarn, including the extrapolated end edge 1*a*', is removed using excising means, thus forming the excised portion 3. At this time, the non-used conductive yarn 2*b* that has been cut but remains on the side of the separated portion 4 and the fabric piece 5 is also removed.

The excising means is not limited as long as both the non-conductive yarn and the conductive yarn 2 in the area that will become the excised portion end edge 3*a* are able to be cut. A punch-shaped blade is preferably used because it enables the excised portion 3 to be formed by simply pushing down from above the fabric surface of the conductive fabric 1 and cutting out (i.e., removing) the fabric weave.

The conductive fabric 1 after the excised portion 3 has been formed by the excising means is connected to the fabric piece 5 by the current-carrying conductive yarn 2*a*, as shown in FIG. 3B, and the width of the separated portion 4 is kept constant. In this state, the connecting member 6 is arranged on the separated portion 4, as shown in FIG. 3C. At this time, the connecting member 6 must be arranged in a position where the conductive surface 6*a* of the connecting member 6 reliably contacts the current-carrying conductive yarn 2*a*. In addition, the connecting member 6 must be arranged in a position where the terminal of the non-used conductive yarn 2*b* that is in the position of the excised portion end edge 3*a* does not contact the conductive surface 6*a* of the connecting member 6. In FIG. 3C, the connecting member 6 is arranged such that none of the excised portion 3 overlaps with the conductive surface 6*a* of the connecting member 6, which is preferable. Also, a connecting member in which the width of the conductive surface 6*a* is not too wide must be selected as the connecting member 6.

Figure 3D:
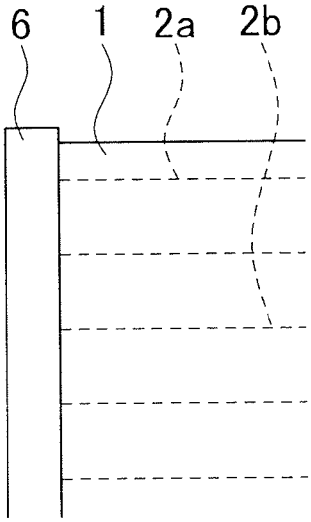
FIG. 3D is a view schematically showing the attaching method of the connecting member according to the first example embodiment of the invention.

Finally, the connecting member 6 need simply be fixed to the conductive fabric 1 by folding the connecting member 6 back so that it wraps around the non-excised end edge la and then sewing it or the like, as shown in FIG. 3D. At this time, the fabric piece 5 may either be excised, or left in a state folded back on the conductive fabric 1 side with the connecting member 6.

In the first example embodiment described above, the fabric end edge in the region including the end portion of the non-used conductive yarn is formed farther to the inside of the fabric surface than the fabric end edge in another region, by forming the excised portion on the fabric end edge in the region that includes the end portion of the non-used conductive yarn. However, a method other than forming the excised portion may also be applied. In a second example embodiment of the invention, instead of forming the excised portion, the fabric end edge in the region including the end portion of the non-used conductive yarn is formed farther to the inside of the fabric surface than the fabric end edge in another region, by forming a folded portion in the region that includes the end portion of the non-used conductive yarn. The conductive fabric according to this second example embodiment will now be described in detail with reference to FIGS. 4A to 4E.

Figure 4A:
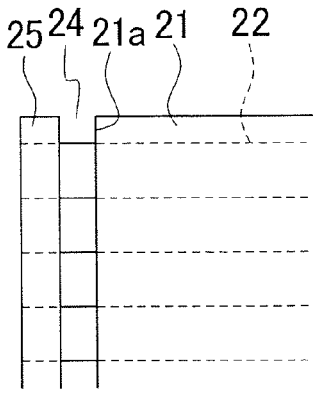
FIG. 4A is a view schematically showing a manufacturing method of conductive fabric according to a second example embodiment of the invention.

A conductive fabric 21 according to the second example embodiment has a structure similar to that of the conductive fabric 1 according to the first example embodiment, except for the structure of the area around the end portion of a non-used conductive yarn 22*b*. First, as shown in FIG. 4A, the conductive fabric 21 is formed connected to a fabric piece 25 by conductive yarn 22 via a separated portion 24. This step is similar to that in the first example embodiment.

Figure 4D:
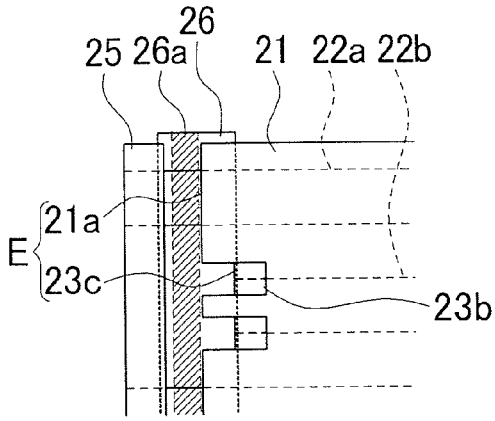
FIG. 4D is a view schematically showing an attaching method of a connecting member according to the second example embodiment of the invention.
Figure 4B:
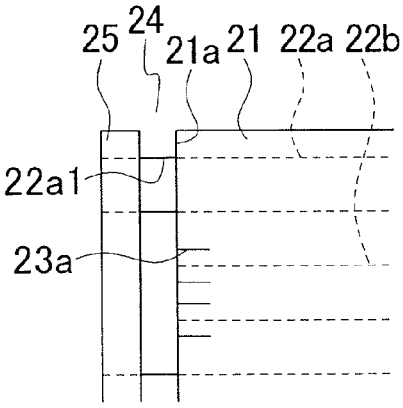
FIG. 4B is a view schematically showing the manufacturing method of the conductive fabric according to the second example embodiment of the invention.
Figure 4E:
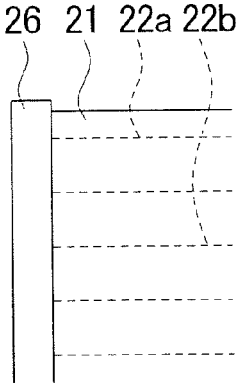
FIG. 4E is a view schematically showing the attaching method of the connecting member according to the second example embodiment of the invention.

Next, the conductive yarn 22 that is to be the non-used conductive yarn 22*b* is selected, and the selected non-used conductive yarn 22*b* is cut at the location of a fabric end edge 21*a*, as shown in FIG. 4B. Together with this, a cut line 23*a* is formed parallel to the direction in which the non-used conductive yarn 22*b* is arranged, in the portion formed by non-conductive yarn arranged on both sides of the end portion of the non-used conductive yarn 22*b*, and the fabric end edge 21*a* is segmented. The cut line 23*a* may be formed using a blade such as a cutter or scissors, or a laser beam or the like.

Figure 4C:
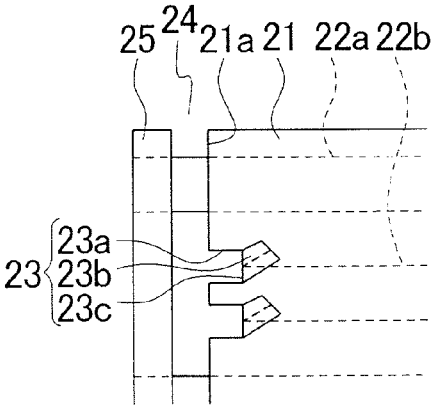
FIG. 4C is a view schematically showing the manufacturing method of the conductive fabric according to the second example embodiment of the invention.
Figure 5:
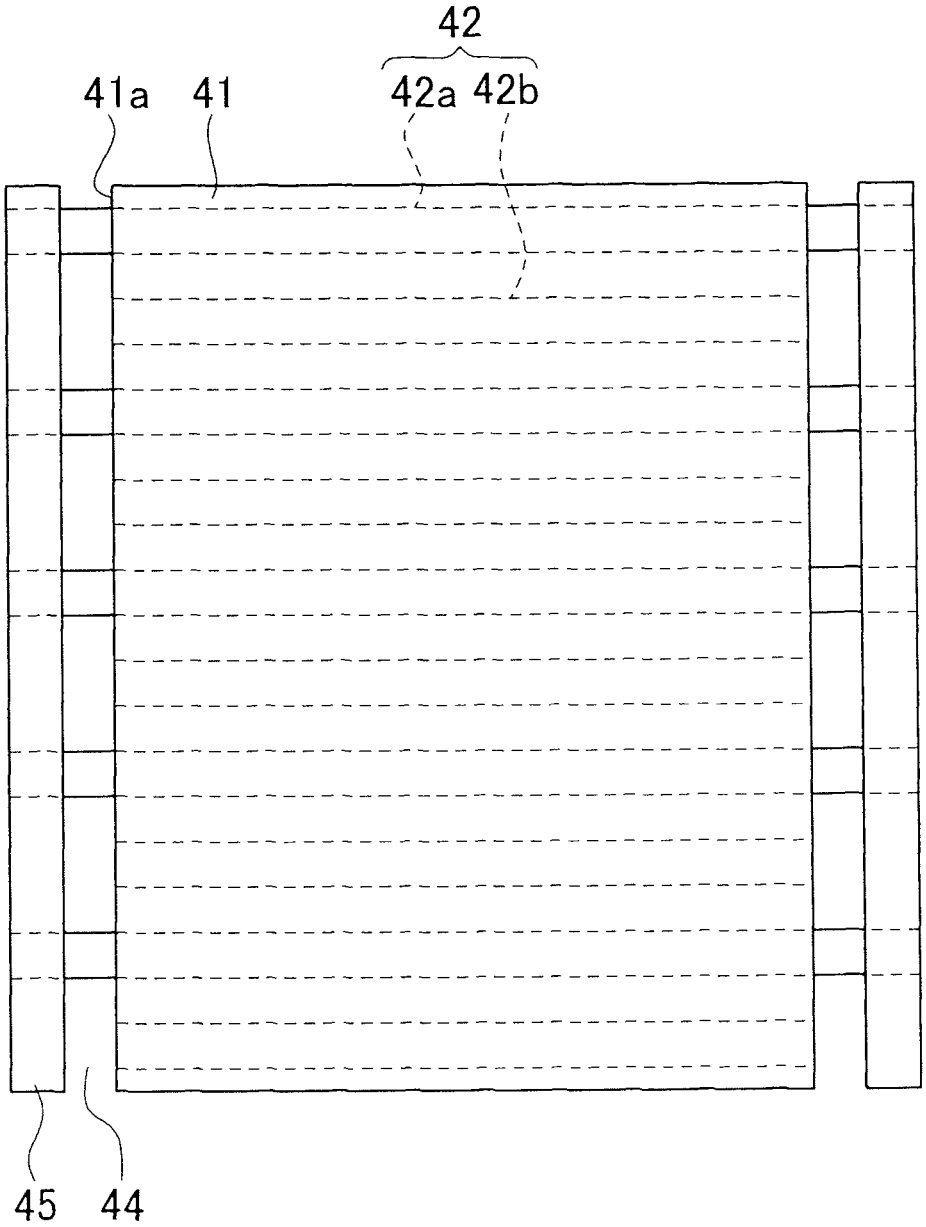
FIG. 5 RELATED ART
FIG. 5 is a front view of conductive fabric provided with non-used conductive yarn using a manufacturing method of the conductive fabric according to related art.

Next, a folded portion 23 is formed by folding back a folded piece 23*b* that is sandwiched between two cut lines 23*a* and includes the end portion of the non-used conductive yarn 22*b*, to the inside of the conductive fabric 21, as shown in FIG. 4C. At this time, a straight line that connects the end portions on the inside of the fabric surface of the two cut lines 23*a*, i.e., a base return line 23*c* of the folded piece 23*b*, and the cut lines 23*a*, form the fabric end edge E at the location where the folded portion 23 is formed.

That is, the new fabric end edge E is a line that connects the original fabric end edge 21*a* in the region other than the location where the folded portion 23 is formed, with the return line 23*c* and the cut lines 23*a*. As a result, the fabric end edge E (i.e., the return line 23*c* and the cut lines 23*a*) in the region that includes the end portion of the non-used conductive yarn 22*b* is formed farther to the inside of the fabric surface than the fabric end edge E (i.e., the original fabric end edge 21*a*) in the other region.

Next, a connecting member 26 is attached to the conductive fabric 21, as shown in FIG. 4D, just as in the case of the first example embodiment. At this time, the connecting member 26 must be arranged in a position where a conductive surface 26*a* of the connecting member 26 reliably contacts the current-carrying conductive yarn 22*a*. In addition, the connecting member 26 must be arranged in a position in which the non-used conductive yarn 22*b* in the folded piece 23*b* does not contact the conductive surface 26*a* of the connecting member 26.

Finally, the connecting member 26 is folded and fixed to the conductive fabric 21 by sewing or the like (FIG. 4E), similar to the first example embodiment. The folded piece 23*b* may fixed at this time by being sewn to the conductive fabric 21 together with the connecting member 26, or it may first be fixed to the conductive fabric 21 after the step shown in FIG. 4D and before the step shown in FIG. 4E. With the latter method, the number of steps increases, but the operation of arranging and fixing the connecting member 26 is easier to perform.

As described above, by forming the excised portion 3 and the folded portion 23, if the end portion of the non-used conductive yarn is withdrawn farther to the inside of the fabric surface than the end edge of the fabric in the other region, for the entire region that is made up of the surrounding non-conductive yarn, then even if the current-carrying conductive yarn and the non-used conductive yarn are adjacent, insulation of the non-used conductive yarn is able to be easily ensured. When the folded portion 23 is formed as in the second example embodiment, when the connecting portion is attached, the thickness of the fabric end edge in the position where the folded portion 23 is formed will increase, but if this is not desirable, an excised portion may simply be formed as in the first example embodiment. Conversely, if it is desirable to increase the strength of the fabric end edge, the conductive fabric according to the second example embodiment in which the folded portion is formed may be selected.

While two example embodiments of the invention have been described in detail, the invention is not intended to be limited to these example embodiments. That is, various modifications are also possible without departing from the scope of the invention. For example, in the example embodiments described above, the current-carrying conductive yarn and the non-used conductive yarn are arranged at equidistant intervals, but they may be arranged in any fashion. For example, when used as a seat heater, if it is desirable to change the heating amount according to the portion of the body (i.e., the body of a person) contacting it, then a region with a high density of current-carrying conductive yarn and a region with a low density of current-carrying conductive yarn may be provided, with a given position as the boundary. Further, in order to reliably set the boundary of these kinds of regions, a region where the non-used conductive yarn is provided in concentration may be formed at the boundary of the regions. Also, the conductive fabric does not need to be formed in a rectangle. That is, the conductive fabric need simply be formed in a shape according to various uses.

In the example embodiments described above, the excised portion and the folded piece are formed separately for the end portion of each strand of the non-used conductive yarn. Alternatively, however, a large excised portion or folded piece may be formed on the collective end portions of a plurality of adjacent non-used conductive yarns. However, care must be taken so that the strength of the overall conductive fabric is not diminished. Finally, it is not absolutely essential to provide the separated portion and the fabric piece.

What is claimed is:

1. A conductive fabric comprising:

conductive yarn; and non-conductive yarn, wherein a fabric end edge in a region that includes an end portion of at least a portion of the conductive yarn is provided in a position recessed farther to an inside of a fabric surface than a fabric end edge in another region, and the fabric end edge in the region that includes the end portion of the at least a portion of the conductive yarn is defined by two cut lines that extend parallel to a direction in which the at least a portion of the conductive yarn is arranged, the two cut lines being a portion of the conductive fabric formed by the non-conductive yarn that is arranged on both sides of the end portion of the at least a portion of the conductive yarn, and a folded edge of a folded portion, that includes the end portion of the at least a portion of the conductive yarn sandwiched between the two cut lines, folded to the inside of the conductive fabric.

2. The conductive fabric according to claim 1, wherein the at least a portion of the conductive yarn is non-used conductive yarn that does not carry current.

3. A conductive fabric comprising:

conductive yarn; and non-conductive yarn, wherein a fabric end edge in a region that includes an end portion of at least a portion of the conductive yarn is provided in a position recessed farther to an inside of a fabric surface than a fabric end edge in another region, the recessed position is provided on an extending direction line axis of the conductive yarn, and the fabric end edge in the region that includes the end portion of the at least a portion of the conductive yarn is defined by two cut lines that extend parallel to a direction in which the at least a portion of the conductive yarn is arranged, the two cut lines being a portion of the conductive fabric formed by the non-conductive yarn that is arranged on both sides of the end portion of the at least a portion of the conductive yarn, and a folded edge of a folded portion, that includes the end portion of the at least a portion of the conductive yarn sandwiched between the two cut lines, folded to the inside of the conductive fabric.

4. The conductive fabric according to claim 1, wherein the fabric end edge in the region that includes the end portion of the at least a portion of the conductive yarn is further defined by a removed portion of a weave of the conductive fabric, including an end portion of the non-conductive yarn and the end portion of the portion of the conductive yarn, the fabric end edge in another region and the fabric end edge in the region that includes the end portion of the at least a portion of the conductive yarn.

5. The conductive fabric according to claim 4, wherein the removed portion of the weave of the conductive fabric is a semicircular shape.

6. The conductive fabric according to claim 3, wherein the at least a portion of the conductive yarn is non-used conductive yarn that does not carry current.

* * * * *